US010119493B2

(12) United States Patent
Wagner et al.

(10) Patent No.: US 10,119,493 B2
(45) Date of Patent: Nov. 6, 2018

(54) MULTI-LAYERED PISTON CROWN FOR OPPOSED-PISTON ENGINES

(71) Applicant: ACHATES POWER, INC., San Diego, CA (US)

(72) Inventors: Bryant A. Wagner, Santee, CA (US); Ryan G. Mackenzie, San Diego, CA (US)

(73) Assignee: ACHATES POWER, INC., San Diego, CA (US)

( * ) Notice: Subject to any disclaimer, the term of this patent is extended or adjusted under 35 U.S.C. 154(b) by 170 days.

(21) Appl. No.: 15/056,909

(22) Filed: Feb. 29, 2016

(65) Prior Publication Data

US 2017/0248099 A1 Aug. 31, 2017

(51) Int. Cl.

| | |
|---|---|
| ***F02F 3/00*** | (2006.01) |
| ***F02B 75/22*** | (2006.01) |
| ***B23P 11/00*** | (2006.01) |
| ***F02F 3/14*** | (2006.01) |
| ***F02B 75/02*** | (2006.01) |
| ***F02B 75/28*** | (2006.01) |
| ***F02F 3/28*** | (2006.01) |

(52) U.S. Cl.

CPC ..... *F02F 3/14* (2013.01); *F02B 75/02* (2013.01); *F02B 75/282* (2013.01); *F02F 3/285* (2013.01); *F02B 75/28* (2013.01); *F02B 2075/025* (2013.01); *F02F 2200/00* (2013.01); *F02F 2200/06* (2013.01); *F05C 2251/048* (2013.01)

(58) Field of Classification Search

CPC ..... F02F 1/24; F02F 1/4285; F02F 2001/249; F02F 3/14; F02F 3/285; F02F 2200/06; F02B 75/282; F02B 77/04; F02B 75/02; F02B 2075/025

USPC ..... 123/51 B, 193.6, 55.5, 55.7; 29/888.04, 29/888.42, 888.045

See application file for complete search history.

(56) References Cited

U.S. PATENT DOCUMENTS

| | | | | |
|---|---|---|---|---|
| 2,494,748 | A | 1/1950 | Ernestus | |
| 3,209,736 | A | 10/1965 | Witzky | |
| 4,242,948 | A | 1/1981 | Stang et al. | |
| 4,604,945 | A * | 8/1986 | Mizuhara | F02F 3/12 92/176 |

(Continued)

FOREIGN PATENT DOCUMENTS

| | | |
|---|---|---|
| EP | 2436898 A1 | 4/2012 |
| EP | 2787207 A1 | 10/2014 |
| GB | 2209014 A | 4/1989 |

OTHER PUBLICATIONS

International Search Report dated May 31, 2017, for counterpart PCT application No. PCT/US2017/018964.

*Primary Examiner* — Syed O Hasan

(74) *Attorney, Agent, or Firm* — Terrance A. Meador; Julie J. Muyco

(57) ABSTRACT

A piston crown for a piston of a pair of pistons in a two-stroke, opposed-piston, compression ignition combustion engine has a barrier layer and a conductive layer. The barrier layer at least partially surrounds a combustion chamber formed by the piston crown and an end surface of an opposing piston. The conductive layer connects the crown to the rest of the piston body. The barrier layer and the conductive layer are joined either through welding or through the fabrication process. Optionally, the piston crown includes an insulating layer between the barrier and conductive layers.

14 Claims, 13 Drawing Sheets

(56) References Cited

U.S. PATENT DOCUMENTS

| | | | | |
|---|---|---|---|---|
| 7,210,399 | B2 | 5/2007 | Ioja | |
| 7,240,643 | B1 | 7/2007 | Perr et al. | |
| 8,813,734 | B2 * | 8/2014 | Kadoshima | F02B 77/11 123/193.1 |
| 9,004,037 | B2 | 4/2015 | Muscas | |
| 9,062,768 | B2 | 6/2015 | Azevedo et al. | |
| 9,127,618 | B2 | 9/2015 | Azevedo et al. | |
| 9,163,579 | B2 | 10/2015 | Aharonov et al. | |
| 9,169,800 | B2 | 10/2015 | Matsuo | |
| 9,464,592 | B2 | 10/2016 | Dion et al. | |
| 9,810,174 | B2 * | 11/2017 | Wahl | F02F 3/16 |
| 2009/0151708 | A1 | 6/2009 | Schouweiler, Jr. | |
| 2011/0041684 | A1 | 2/2011 | Kortas et al. | |
| 2012/0073541 | A1 | 3/2012 | Fuqua et al. | |
| 2013/0213342 | A1 * | 8/2013 | Burton | F02F 3/26 123/193.6 |
| 2014/0090625 | A1 | 4/2014 | Dion et al. | |
| 2017/0030262 | A1 | 2/2017 | Venugopal | |

* cited by examiner

MULTI-LAYERED PISTON CROWN FOR OPPOSED-PISTON ENGINES

RELATED APPLICATIONS

This Application contains subject matter related to the subject matter of the following commonly-owned patent applications: U.S. patent application Ser. No. 14/815,747, filed on Jul. 31, 2015, which was published as US 2017/0030262 on Feb. 2, 2017; and U.S. patent application Ser. No. 13/891,523, filed on May 10, 2013, which was published as US 2014/0090625 on Apr. 3, 2014 and which issued as U.S. Pat. No. 9,464,592 on Oct. 11, 2016.

FIELD

The field includes constructions for thermal management in opposed-piston engines in which a combustion chamber is defined between end surfaces of pistons disposed in opposition in the bore of a cylinder. More particularly, the field includes opposed-piston engines with combustion chambers that minimize heat loss from the combustion chamber to other parts of the engine.

BACKGROUND

The related patent applications describe two-stroke cycle, compression-ignition, uniflow-scavenged, opposed-piston engines in which pairs of pistons move in opposition in the bores of ported cylinders. A two-stroke cycle opposed-piston engine completes a cycle of engine operation with two strokes of a pair of opposed pistons. During a compression stroke, as the pistons begin to move toward each other, charge air is admitted into the cylinder, between the end surfaces of the pistons. As the pistons approach respective top dead center ("TDC") locations to form a combustion chamber the charge air is increasingly compressed between the approaching end surfaces. When the end surfaces are closest to each other, near the end of the compression stroke, a minimum combustion chamber volume ("minimum volume") occurs. Fuel injected directly into the cylinder mixes with the compressed charge air. Combustion is initiated when the compressed air reaches temperature and pressure levels that cause the fuel to begin to burn; this is called "compression ignition". Combustion timing is frequently referenced to minimum volume. In some instances, injection occurs at or near minimum volume; in other instances, injection may occur before minimum volume. In any case, in response to combustion the pistons reverse direction and move away from each other in a power stroke. During a power stroke, the pistons move toward bottom dead center ("BDC") locations in the bore. As the pistons reciprocate between top and bottom dead center locations they open and close ports formed in respective intake and exhaust locations of the cylinder in timed sequences that control the flow of charge air into, and exhaust from, the cylinder.

In order to maximize the conversion of the energy released by combustion into motion, it is desirable to prevent heat from being conducted away from the combustion chamber through the piston. Reduction of heat lost through the piston increases the engine's operating efficiency. Typically, heat transfer through the piston is reduced or blocked by insulating the piston crown from the body of the piston. However, it is also the case that retention of the heat of combustion at the end surface of the piston can cause thermal damage to the piston crown and nearby piston elements.

Piston thermal management is a constant concern, especially given the ever-increasing loads expected from modern internal combustion engines. In a typical piston, at least four areas are of concern for thermal management: the piston crown, the ring grooves, the piston under-crown, and the piston/wristpin interface. The piston crown can be damaged by oxidation if its temperature rises above the oxidation temperature of the materials of which it is made. Mechanical failure of piston elements can result from thermally-induced material changes. The rings, ring grooves, and the lands that border the ring grooves can suffer from carbon build-up caused by oil heated above the coking temperature. As with the ring grooves, the under surface of the piston crown can also suffer from oil coking.

A recent study indicates that an opposed-piston engine two-stroke cycle engine exhibits increased thermal efficiency when compared with a conventional six-cylinder four-cycle engine. (Herold, R., Wahl, M., Regner, G., Lemke, J. et al., "Thermodynamic Benefits of Opposed-Piston Two-Stroke Engines," SAE Technical Paper 2011-01-2216, 2011, doi:10.4271/2011-01-2216.) The opposed-piston engine achieves thermodynamic benefits by virtue of a combination of three effects: reduced heat transfer due to a more favorable combustion chamber area/volume ratio, increased ratio of specific heats from leaner operating conditions made possible by the two-stroke cycle, and decreased combustion duration achievable at the fixed maximum pressure rise rate arising from the lower energy release density of the two-stroke engine. With two pistons per cylinder, an opposed-piston engine can realize additional thermodynamic benefits with enhanced piston thermal management.

SUMMARY

Enhanced thermal management of the pistons of an opposed-piston engine is realized by provision, in each piston of a pair of opposed pistons, of piston crowns made of two or more layers of different materials. The pistons with multiple layers described herein reduce the transfer of heat from the combustion chamber and piston crown to the piston body, while at the same time reducing or preventing thermal damage to the rings and coking of lubricant in the ring grooves.

In some implementations, a piston crown of a piston of a pair of pistons of an opposed-piston engine includes a barrier layer at the piston end surface and a conductive layer adjacent to the barrier layer, in which the barrier layer contacts the fuel and air during combustion while the conductive layer connects the barrier layer to the piston skirt and other piston components.

In a related aspect, a method is provided for making a piston crown of a piston of a pair of pistons of an opposed-piston engine that includes a barrier layer at the piston end surface and a conductive layer adjacent to the barrier layer, in which the barrier layer contacts the fuel and air during combustion while the conductive layer connects the barrier layer to the piston skirt and other piston components.

DETAILED DESCRIPTION OF THE PREFERRED EMBODIMENTS

Figure 1:
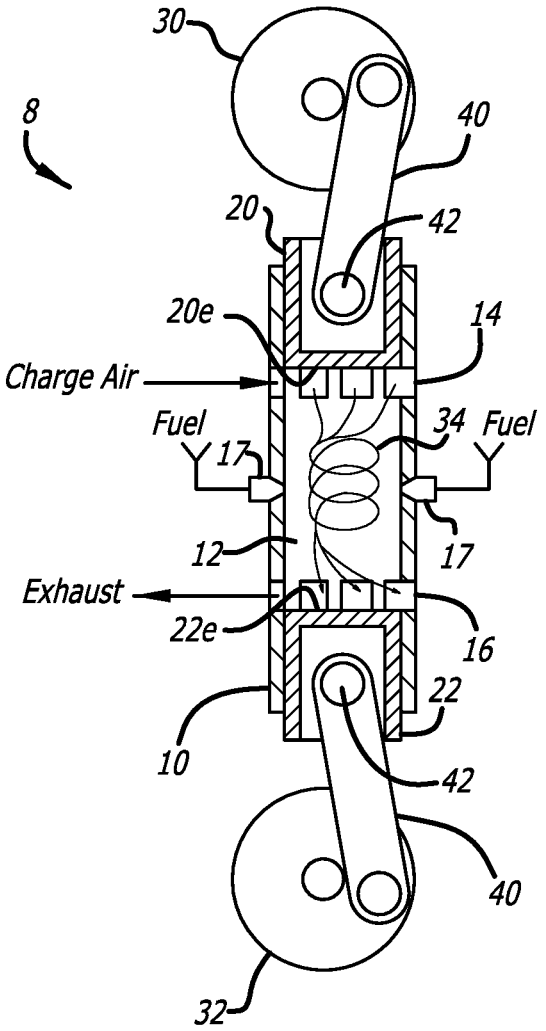
FIG. 1 (Prior Art)
FIG. 1 is a schematic illustration of an opposed-piston engine of the prior art.

FIG. 1 is a schematic representation of a two-stroke cycle internal combustion engine 8 of the opposed-piston type that includes at least one cylinder 10. The cylinder includes a bore 12 and longitudinally displaced intake and exhaust ports 14 and 16 machined or formed in the cylinder, near respective ends thereof. Each of the intake and exhaust ports includes one or more circumferential arrays of openings in which adjacent openings are separated by a solid portion of the cylinder wall (also called a "bridge"). In some descriptions, each opening is referred to as a "port"; however, the construction of a circumferential array of such "ports" is no different than the port constructions in FIG. 1.

Fuel injection nozzles 17 are secured in threaded holes that open through the side surface of the cylinder. Two pistons 20, 22 are disposed in the bore 12 with their end surfaces 20*e*, 22*e* in opposition to each other. For convenience, the piston 20 is referred to as the "intake" piston because of its proximity to the intake port 14. Similarly, the piston 22 is referred to as the "exhaust" piston because of its proximity to the exhaust port 16. Preferably, but not necessarily, the intake piston 20 and all other intake pistons in the opposed-piston engine are coupled to a crankshaft 30 disposed along one side of the engine 8; and, the exhaust piston 22 and all other exhaust pistons are coupled to a crankshaft 32 disposed along the opposite side of the engine 8.

Operation of an opposed-piston engine such as the engine 8 with one or more ported cylinders (cylinders with intake and exhaust ports formed near ends thereof) such as the cylinder 10 is well understood. In this regard, in response to combustion the opposed pistons move away from respective TDC positions where they are at their innermost positions in the cylinder 10. While moving from TDC, the pistons keep their associated ports closed until they approach respective BDC positions where they are at their outermost positions in the cylinder and the associated ports are open. The pistons may move in phase so that the intake and exhaust ports 14, 16 open and close in unison. Alternatively, one piston may lead the other in phase, in which case the intake and exhaust ports have different opening and closing times.

As charge air enters the cylinder 10 through the intake port 14, the shapes of the intake port openings cause the charge air to rotate in a vortex 34 about the cylinder's longitudinal axis, which spirals in the direction of the exhaust port 16. A swirl vortex 34 promotes air/fuel mixing, combustion, and suppression of pollutants. Swirl velocity increases as the end surfaces 20*e* and 22*e* move together. FIGS. 2-5 illustrate art exemplary piston for an opposed piston engine that is described in greater detail in related U.S. patent application Ser. No. 14/815,747.

Figure 2:
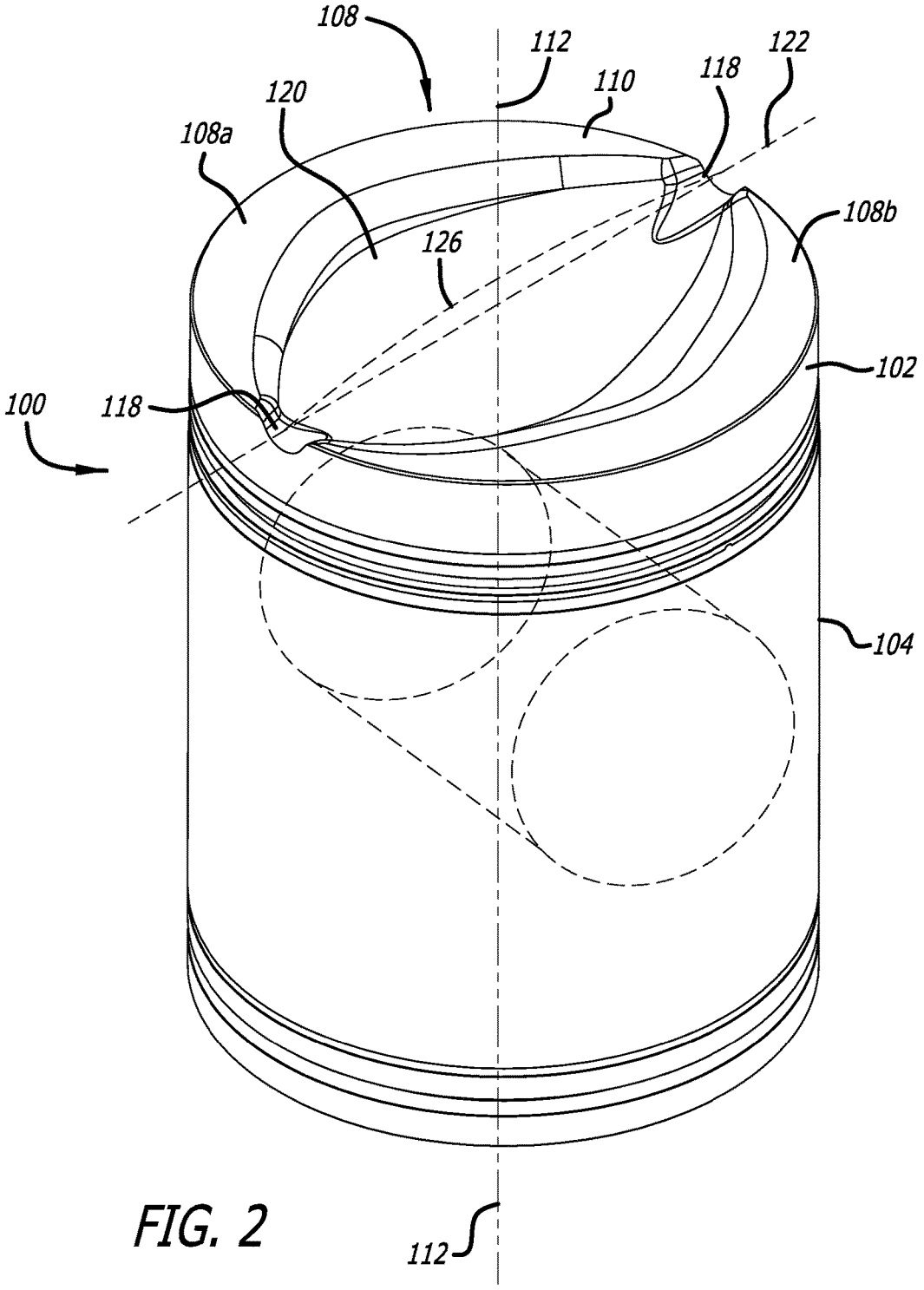
FIG. 2 is an isometric view of an exemplary piston for use with an opposed-piston engine.
Figure 3:
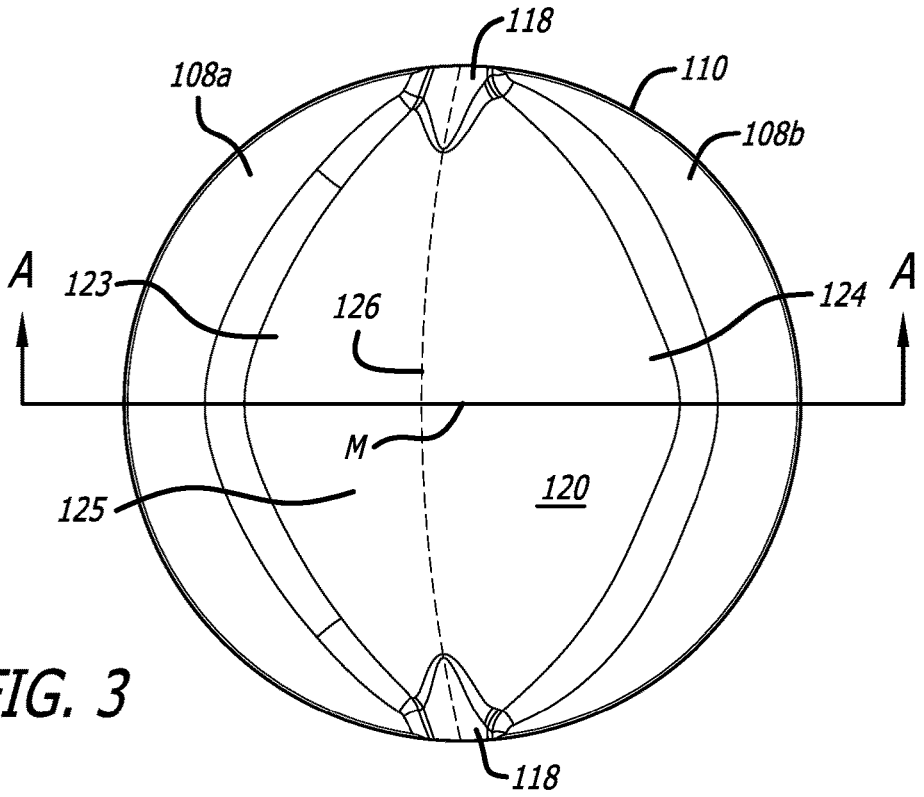
FIG. 3 is a plan view of the end surface of the piston of FIG. 2.

FIG. 2 is an isometric view of a piston 100 for an opposed-piston engine; FIG. 3 is a plan view of the end surface of the piston. Referring now to FIGS. 2 and 3, the structural features of piston end surfaces that define the combustion chamber are essentially the same, if not identical, for each piston; accordingly, the piston 100 shown in these figures represents intake and exhaust pistons. The piston 100 comprises a crown 102 attached to, affixed to, or manufactured with a skirt 104 to form a continuous cylindrical sidewall of the piston. The crown 102 comprises a flat end surface 108. The sidewall and end surface 108 meet at a peripheral edge 110. The peripheral edge 110 has a circular shape that is centered on the longitudinal axis 112 of the piston as shown in the plan view of FIG. 3. A pair of notches 118 and a concave bowl 120 are formed in the end surface 108. The notches 118 are positioned in opposition in the peripheral edge 110, in alignment with a diameter 122 of the piston at the end surface.

With reference to FIG. 3, the concave bowl 120 has an oblong shape that is elongated along the diameter 122 and that connects smoothly with each notch 118. The concave bowl 120 is abutted on opposing sides of its opening by flat end surface portions 108*a* and 108*b* that extend to the peripheral edge 110. The peripheral edge 110 and the flat end surface portions 108*a* and 108*b* are disposed at a single longitudinal level of the piston where an end surface plane, orthogonal to the longitudinal axis 112 and intersecting the end surface diameter 122, is defined.

Figure 4:
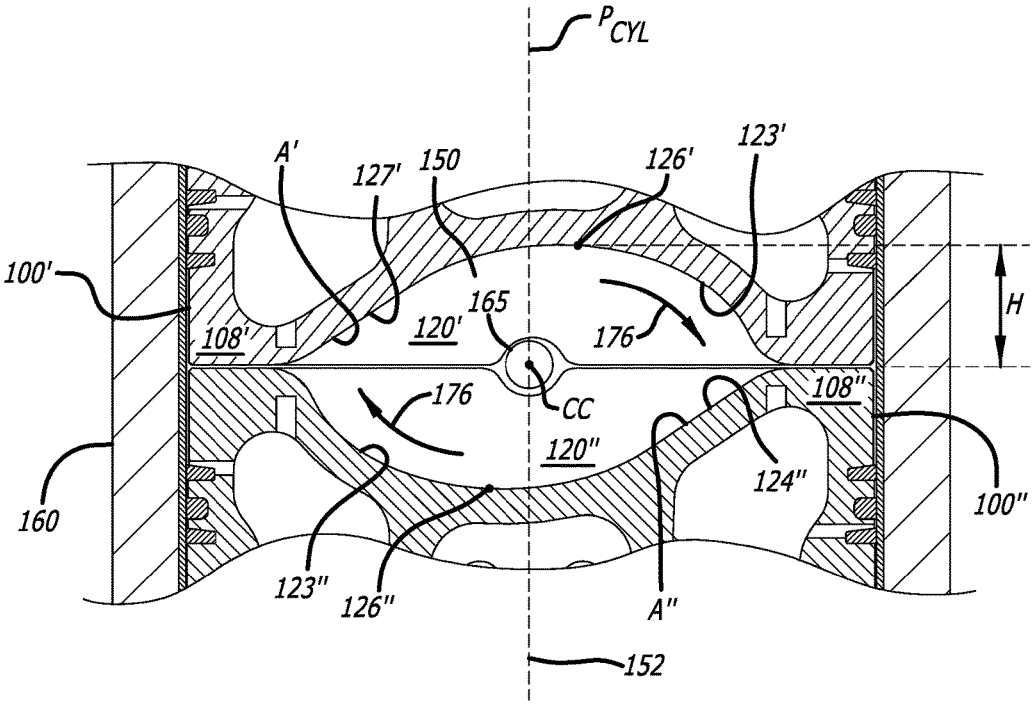
FIG. 4 is a longitudinal diametric sectional view of a combustion chamber formed between the opposing end surfaces of a pair of pistons having end surfaces shaped as per FIG. 3, the view is taken along the line A-A indicated in FIG. 3.

The longitudinal diametric sectional view of a combustion chamber seen in FIG. 4 shows a combustion chamber 150 formed between end surfaces of two pistons 100' and 100" disposed in opposition in the bore of a cylinder 160. The sectional view is transverse to a combustion chamber centerline CC, which is seen in the center of the combustion chamber 150. The end surfaces 108' and 108" are constructed according to FIGS. 2 and 3. The pistons 100' and 100" are rotated on their longitudinal axes to positions in which the notches 118 of the end surfaces are aligned in longitudinal opposition, and the bowls 120 are mutually oriented so that deflection portions A' and A" are in opposition respectively with steeply curved sidewalls 123" and 123'. This disposes the skewed shapes of the bowls in an opposed facing alignment that defines a combustion chamber 150 having a shape that is rotationally skewed in the longitudinal sectional view of FIG. 4. Although the figure illustrates a rotational skew in a clockwise direction, it should be evident that the pistons may be rotated to orient the skew in a counterclockwise direction. The combustion chamber's shape is rotationally skewed because the deepest portions of the bowls 120' and 120" are disposed on opposite sides of a longitudinal plane $P_{CYL}$ that contains a longitudinal axis 152 of the cylinder and that coincides with the longitudinal planes of the pistons 100' and 100". Further, the skew is centered on the combustion chamber centerline CC, which is aligned with the piston diameters 122. The combustion chamber has an elongated shape with opposite end portions that taper along the combustion chamber centerline CC toward fuel injectors 165 that are mounted in a cylinder sidewall 170. The fuel injectors 165 are aligned with the combustion chamber centerline CC and positioned to inject opposing fuel sprays into the combustion chamber 150 through injection ports that are defined between opposing notches 118. For example, the fuel injectors 165 may be constructed to emit fuel sprays that comprise a plurality of plumes having injection axes that are either collinear with the chamber centerline CC, in the manner illustrated in FIGS. 10A-10C of related U.S. Pat. No. 8,820,294, or that are tangential the chamber centerline CC. For example, the fuel sprays may comprise three plumes or four plumes.

In the sectional view of FIG. 4, the pistons 100' and 100" are near TDC locations in the bore and the combustion chamber 150 is near minimum volume. In this figure, as the pistons approach each other at minimum volume, squish motion from between the peripheries of the piston end into the combustion chamber becomes stronger. This squish flow preferentially separates more where the bowl profiles are deeper (123' and 123") as compared to the shallower regions of the bowls (A' and A"). This preferential flow separation sets up a rotational structure 176 circulating around the combustion chamber centerline CC. As can be seen, the rotational structure circulates transversely to the swirl axis, which is generally collinear with the cylinder axis 112: the structure 176 is therefore tumble. The strength of this tumble motion increases as the disposition of the deepest portions of the opposed bowls increases. The generation of this tumble motion is useful to ensure the diffusion plumes resulting from ignition of the fuel sprays emanating from the opposing injectors are centered in the combustion chamber, thus minimizing heat rejection to the combustion chamber walls.

Figure 5A:
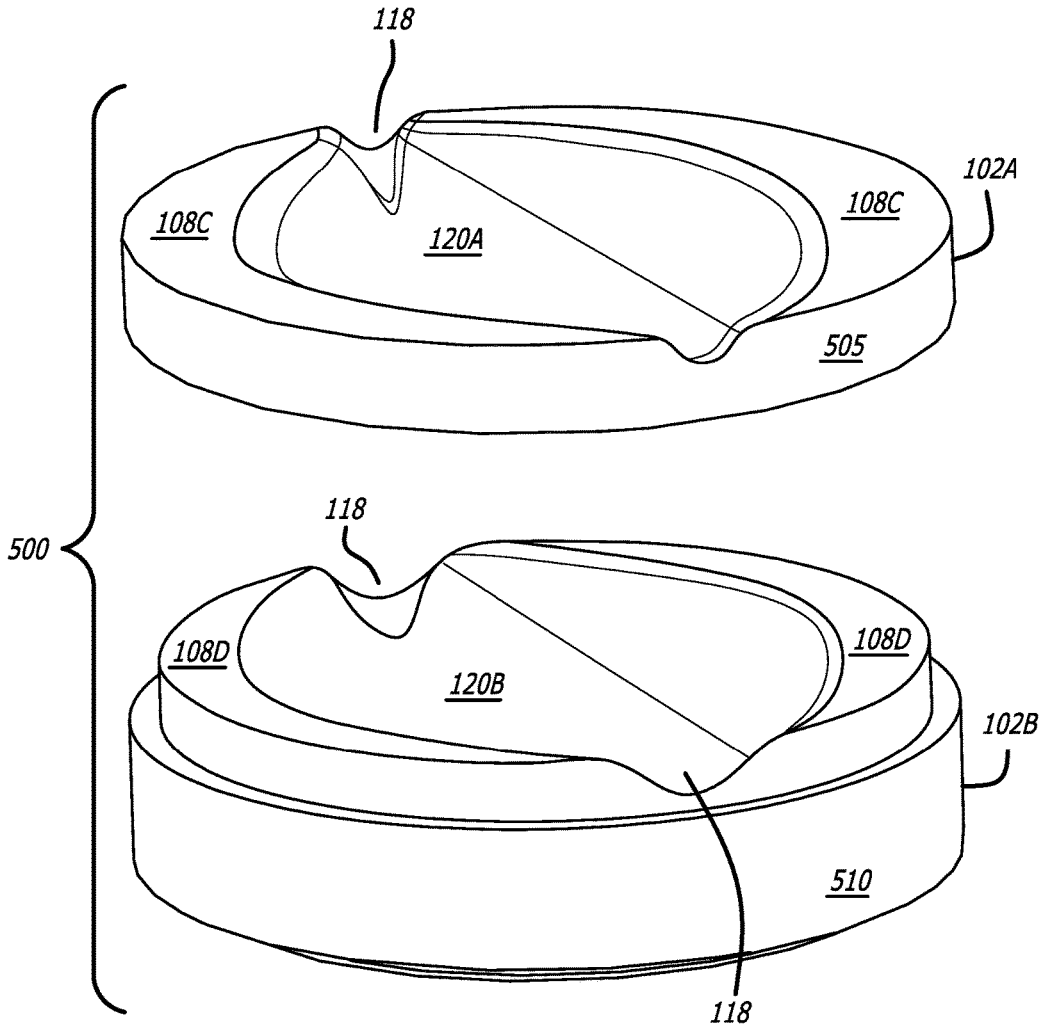
FIG. 5A is an exploded view of a piston crown with two layers, a barrier layer and a conductive layer.

FIG. 5A shows an exploded view of a piston crown 500 with two layers, a barrier layer 102A and a conductive layer 102B. The barrier layer 102A includes a concave bowl 120A and a pair of notches 118 that are formed to fit over the conductive layer 102B, particularly the corresponding bowl 120B and notches 118 formed in the conductive layer 102B. The barrier layer 102A and the conductive layer 102B can be manufactured separately from different materials and then welded together. This piston crown 500 is attached to the other portions of the piston, above the piston ring grooves, by welding or any other suitable attachment methods.

The barrier layer 102A includes flat portions of the end surface 108C, the concave bowl 102A, the pair of notches, and a sidewall 505. In this piston crown 500, the barrier layer 102A forms part of the walls of the combustion chamber (150 in FIG. 4). Heat is reflected toward the combustion chamber by the barrier layer 102A, so that heat is not lost to other portions of the piston, the engine cylinder, or the environment. The barrier layer 102A is made of a material that has a thermal conductivity of 15 W/m·° C. or less, will not oxidize at the high temperatures experienced by the walls of the combustion chamber, and will not appreciably lose strength over time at the combustion temperature. Materials that can be used for the barrier layer 102A include superalloys, for example Hastelloy®, Inconel®, Waspaloy®, René® alloys, Haynes alloys, Incoloy®, MP98T, and CMSX single crystal alloys. Machining, in addition to additive manufacturing, forging, casting, magnetic pulse forming, and the like, can be used to form the barrier layer 102A. The thickness of the portion of the barrier layer 102A that forms the combustion chamber, the bowl 120A, will depend on the material properties of the barrier layer 102A and the overall size of the piston. For example, for a 98 mm diameter piston, the thickness of the barrier layer as described above would be about 3.5 mm for a layer made of Inconel®. For a 130 mm diameter piston, an Inconel® barrier layer would have a thickness as described above of about 5 mm. Additionally, the thickness of the barrier layer may vary across the area of the layer; that is to say the barrier layer may be non-uniform in thickness. The non-uniformity in thickness can be achieved by creating hollow, trenches, pits, and the like, on the back side of the barrier layer (e.g., the side that interfaces with the conductive layer), either during fabrication (e.g., during casting) or after fabrication of the barrier layer 102A, but before joining to the conductive layer 102B. The barrier layer 102A will be made to operate in a combustion temperature range such as 400° C. to 750° C. In some embodiments, the barrier layer 102A will be able to operate in a combustion chamber reaching a temperature in a range of 450° C. to about 725° C., such as about 500° C. to about 700° C.

The conductive layer 102B includes features similar to those of the barrier layer 102A, including flat portions 108D, a pair of notches 118, a concave bowl 120B, and a sidewall 510. The dimensions of the features allow for a tight fitting between the barrier layer 102A and the conductive layer 102B. The conductive layer 102B quickly transports and dissipates heat away from the piston crown. The barrier layer 102A protects the conductive layer 102B from the high temperatures of the combustion chamber, so that the conductive layer and other parts of the piston will not suffer from: oxidization, loss in strength, or over-heating of any lubricant in contact with the piston. Materials conventionally used for engine pistons are suitable for use in the conductive layer 102B. For example, the conductive layer 102B can be made of steel, stainless steel, cast iron, aluminum, aluminum alloys, magnesium, magnesium alloys, and the like. The materials used for the conductive layer 102B have thermal conductivity values of 25 W/m·° C. or more.

Like the barrier layer 102A, the conductive layer 102B can be made by additive manufacturing, forging, casting, magnetic pulse forming, machining, and the like, or any suitable combination of these methods. The thickness of the portion of the conductive layer 102B that supports the combustion chamber, the bowl 120B, will depend on the material properties of the conductive layer 102B and the overall size of the piston. For example, for a 98 mm diameter piston, the thickness of the conductive layer as described above would be about 3.5 mm, and for a 130 mm diameter piston, a conductive layer would have a thickness as described above of about 5 mm. The thickness of the conductive layer may vary across the layer, so that the thickness of the conductive layer is non-uniform.

The fitting between the back side of the barrier layer and the top of the conductive layer may generally be a tight fitting, but in some implementations, areas where the two layers do not contact may exist. These areas where the barrier and conductive layers do not contact, or voids, may be filled with gas or may be evacuated. The location and dimensions of these voids vary with the materials used for the barrier and conductive layers, as well as the configuration of the features of the piston crown. Voids, in conjunction with variations in thickness of the barrier and conductive layers, can be used to regulate uniformity of the temperature of the combustion chamber. The location of voids can reduce the temperature difference between hot spots and cold spots or areas of average temperature in the combustion chamber. Possible locations of voids include areas under the junction of the bowl 120A with flat portions of the end surface of the piston crown and areas under the notches 118. The voids can vary in size, as well as location. In height, voids can be ⅓ or less of the thickness of the barrier layer 102A. Alternatively, voids can be ½ or less of the thickness of the barrier layer 102A.

To form a single piston crown 500 from the barrier layer 102A and the conductive layer 102B, a method of joining the layers can be selected to suit the materials of the layers. The layers can be joined in forming, for example through additive manufacturing. Additive manufacturing can include casting a first layer, one of the barrier or conductive layers, then casting the other layer on the first layer, or casting a first layer then adding powdered metal to create the second layer that is sintered or heat treated to form the unitary piston crown. Adhesive or joining methods can be used to form a single piston crown from the barrier and conductive layers. Such joining methods can include welding along the side walls using electron beam welding, laser welding, magnetic pulse forming/welding, or impulse welding techniques. Further, any other suitable joining technique can be used to make a single piston crown 500 from a barrier layer 102A and conductive layer 102B. In some implementations, the joining technique can join the barrier layer 102A and conductive layer 102B along the sidewalls 505, 510 so that there may be a discontinuity between the layers 102A and 102B in the interior of the crown to form the voids described above. In the voids there may be a vacuum or air when the layers are joined using welding or other adhesive joining methods. When additive manufacturing, such as casting and overcasting, are used to form the barrier layer 102A and conductive layer 102B, the void can be filled with a foamed material instead of gas or instead of being evacuated.

Figure 5B:
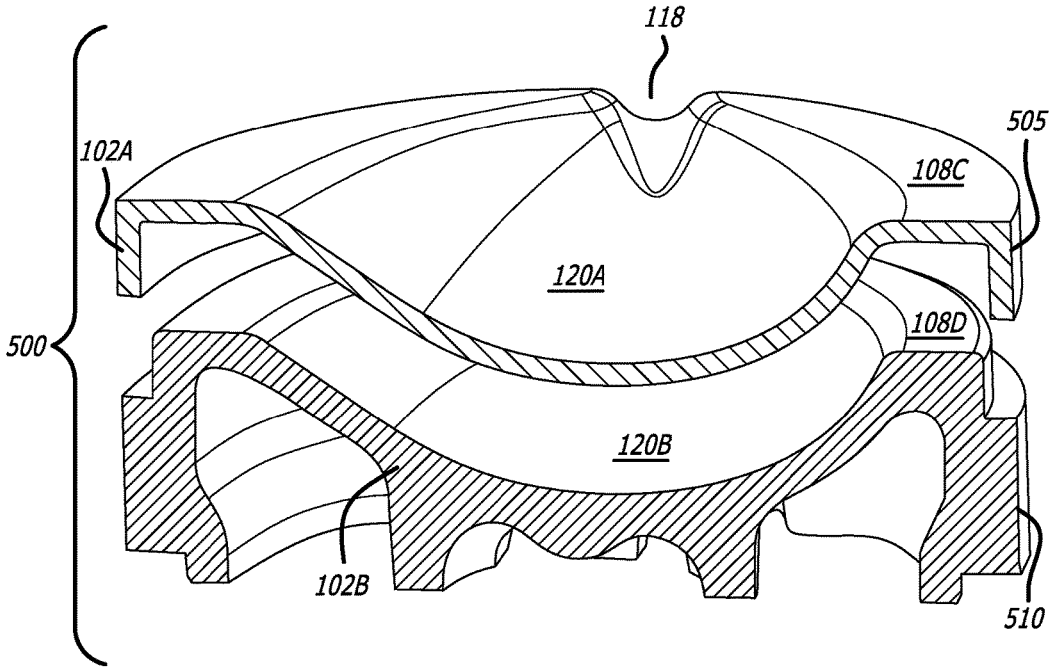
FIG. 5B is an exploded, cross-sectional view of a piston crown with two layers, a barrier layer and a conductive layer.
Figure 5C:
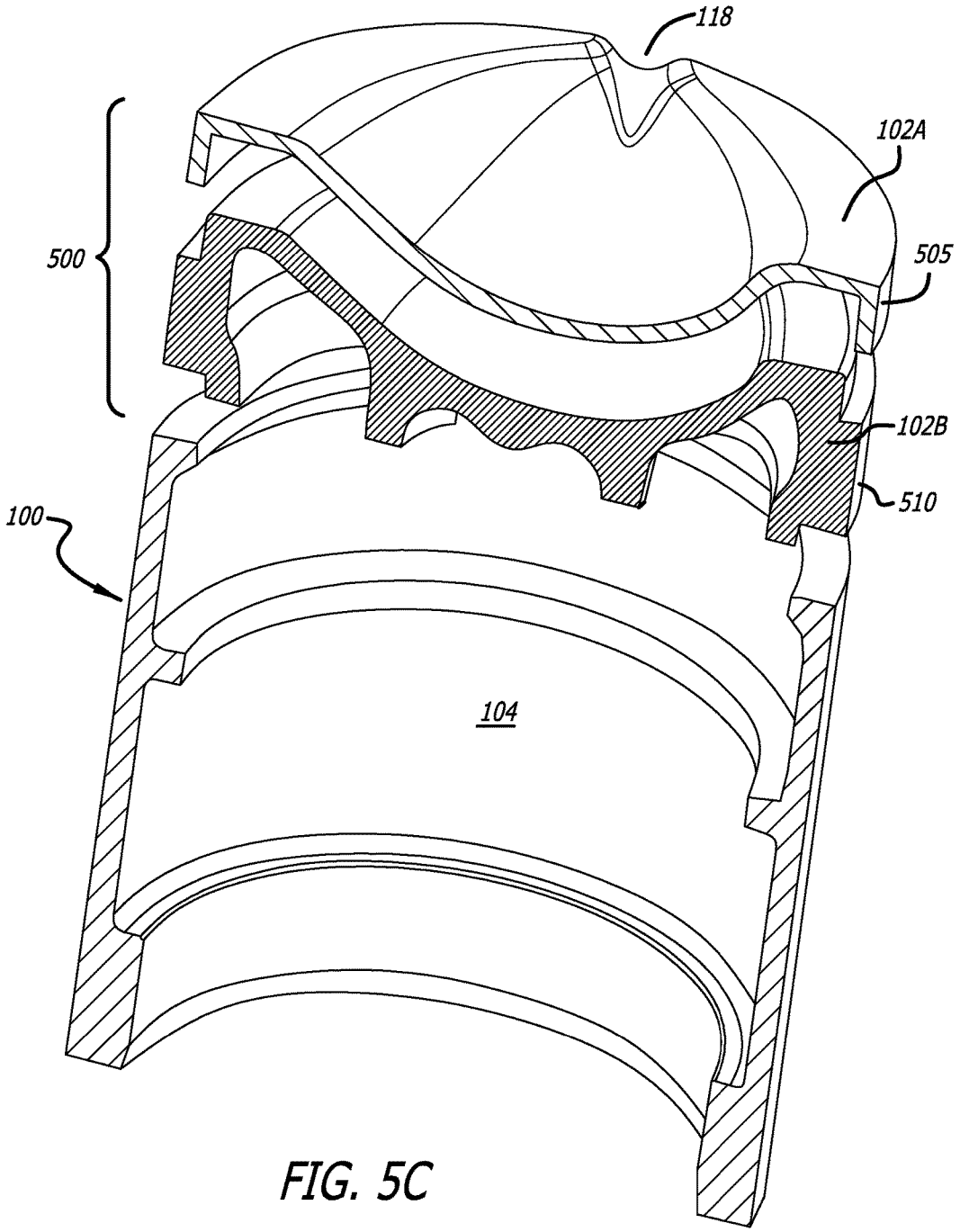
FIG. 5C is an exploded, cross-sectional view of a piston that includes a skirt and a piston crown with two layers.

FIG. 5B is a cross-sectional view of the piston crown 500 shown in FIG. 5A. In this view, the barrier layer 102A and the conductive layer 102B can be seen with their side walls 505 and 510, respectively, and features that fit together to form the crown. The notches 118, bowls 120A and 120B, and flat portions 108C and 108D are formed based upon the materials selected for the barrier layer 102A and the conductive layer 102B to obtain a piston crown that will appropriately retain heat in the combustion chamber without loss of performance of the piston over time or the creation of undesirable hot spots. FIG. 5C is an exploded, cross-sectional view of a piston similar to that shown in FIG. 5B above a piston skirt.

Figure 6A:
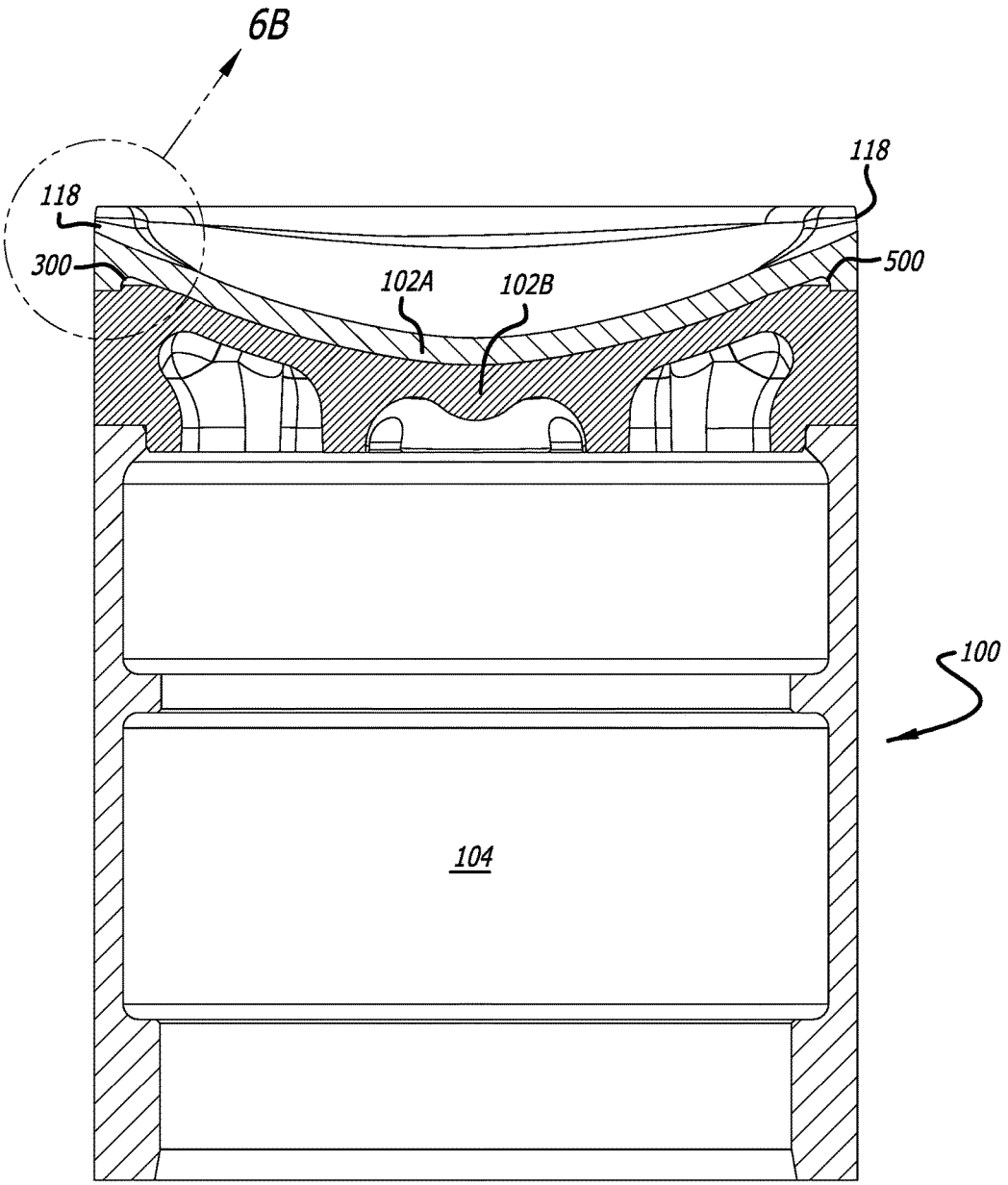
FIG. 6A is a cross-sectional view of a piston that includes a skirt and a piston crown with two layers.
Figure 6B:
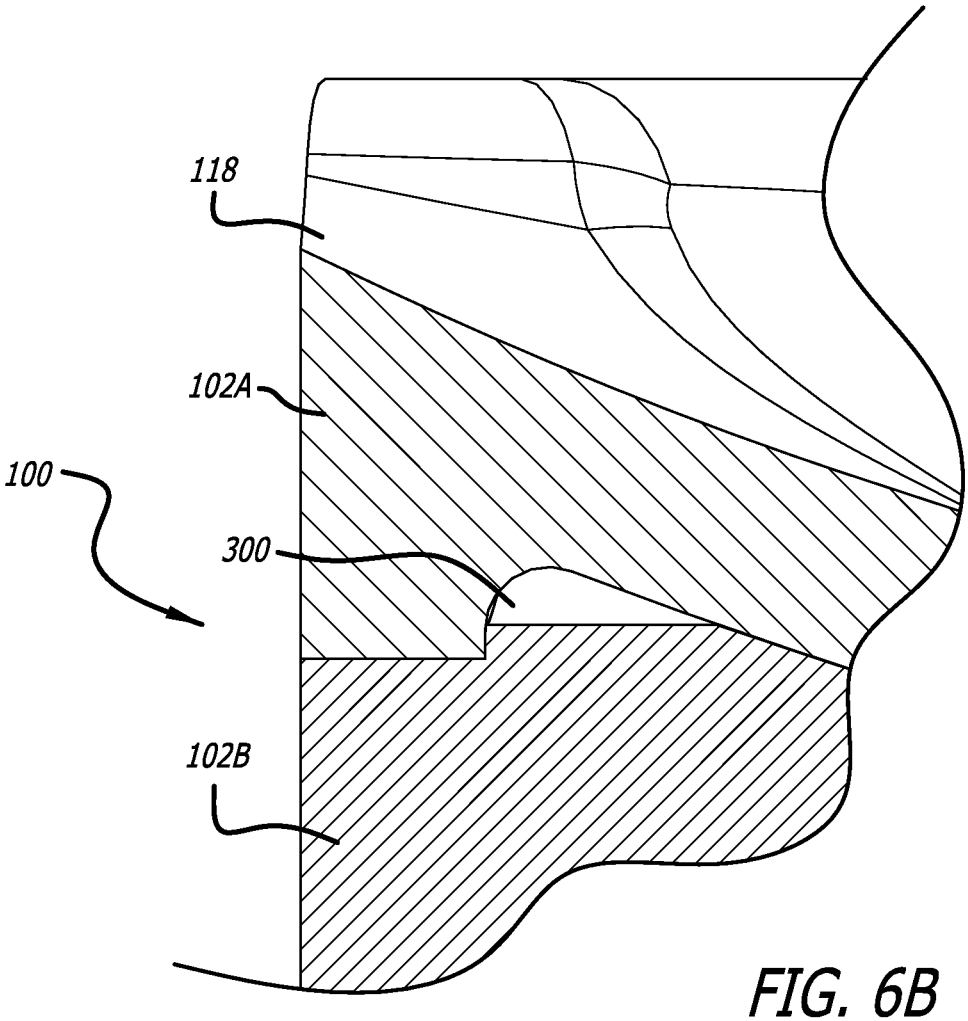
FIG. 6B is an enlarged view of the portion indicated as 6B in FIG. 6A.

FIG. 6A shows a piston 100 with a skirt 104 and a piston crown 500 similar to the piston crown shown in FIG. 5A. In addition to the barrier layer 102A and the conductive layer 102B, voids 300 are shown positioned between two layers of the piston crown 500. The voids 300 reduce or block transfer of heat from the combustion chamber to the lower part of the piston 100, functioning as a thermal resistor. Preferably, but not necessarily, the voids 300 contain a material with low thermal conductivity. Examples of a low thermal conductivity material include air, ceramics, and/or graphite, including foamed material. In some implementations, instead of a low thermal conductivity material, the voids 300 can be evacuated, so that gas has been removed from the void 300 and the pressure inside the void 300 is less than atmospheric pressure. The voids 300 can form an annular chamber, for example under the interface of the bowl and flat portions of the end surface of the piston. Filing the voids 300 with ceramic, graphite, or other equivalent material adds structural integrity to the piston. FIG. 6B shows an enlarged view of one of the voids 300 between the barrier layer 102A and the conductive layer 102B.

Figure 7A:
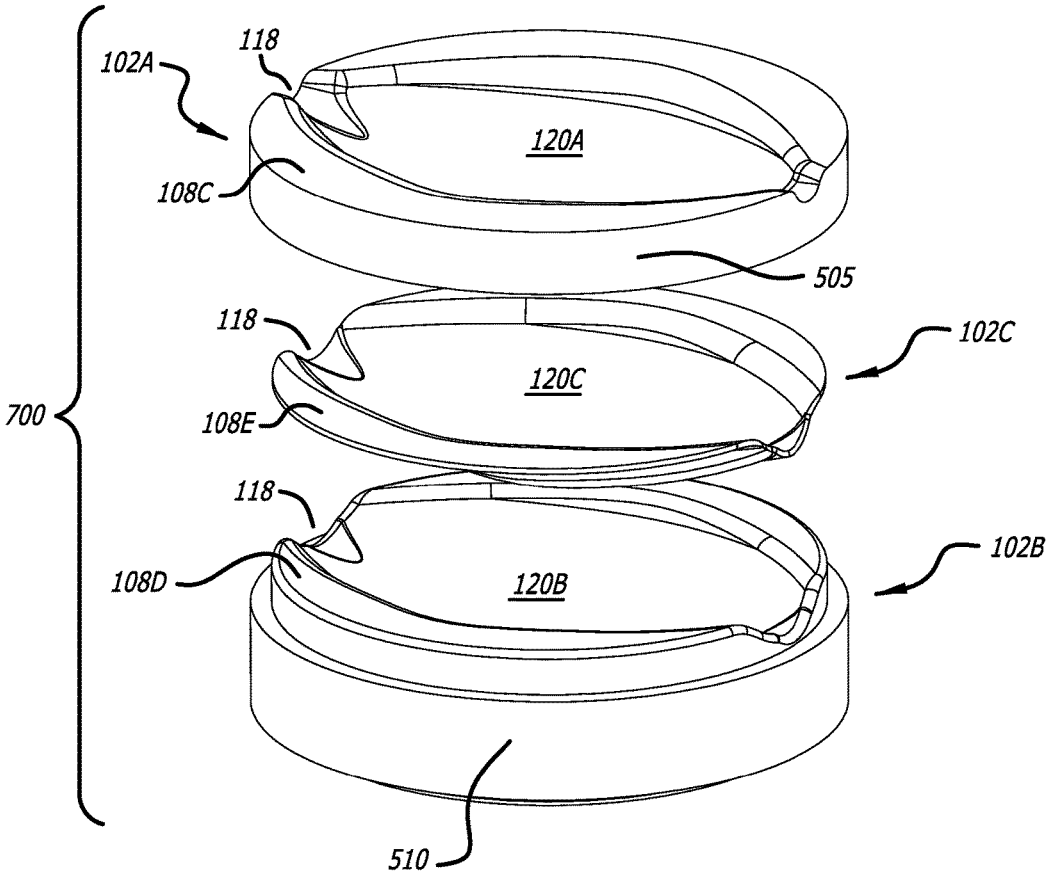
FIG. 7A is an exploded view of a piston crown with three layers, a barrier layer, an insulating layer, and a conductive layer.
Figure 7B:
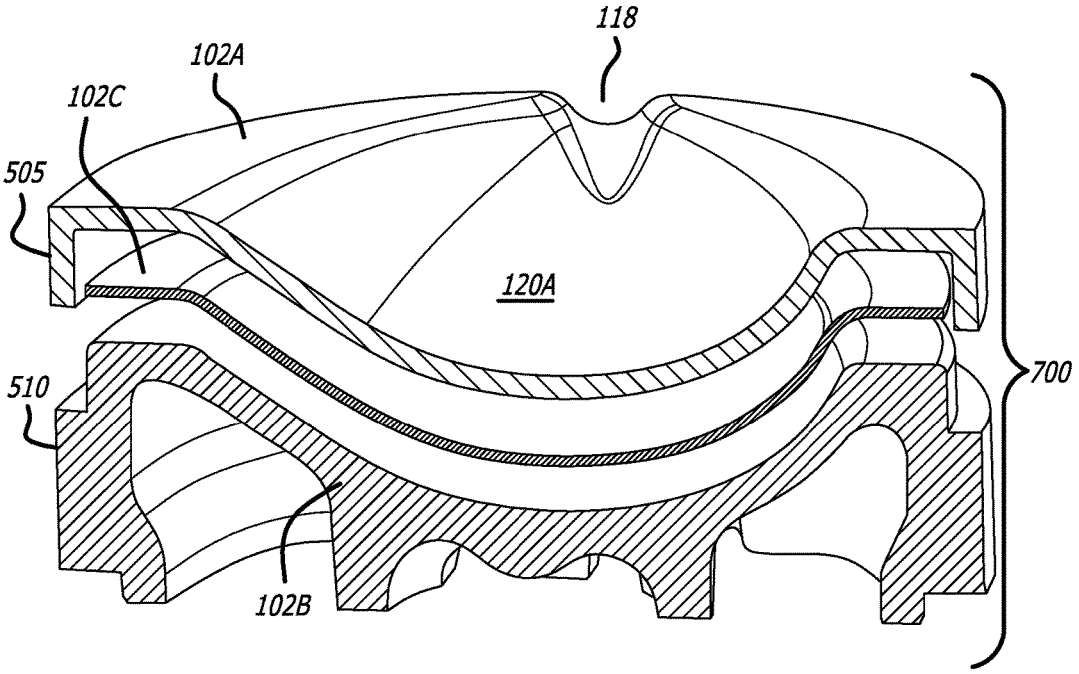
FIG. 7B is an exploded, cross-sectional view of a piston crown with three layers, a barrier layer, an insulating layer, and a conductive layer.

FIG. 7A shows an exploded view of a piston crown 700 with three layers, a barrier layer 102A, a conductive layer 102B, and an insulating layer 102C. The barrier layer 102A and conductive layer 102B of the piston crown 700 can be the barrier layer and conductive layer described with respect to the two-layered piston crown 500 shown in FIG. 5A, but modified in dimensions to accommodate an insulating layer 102C between the barrier layer 102A and conducting layer 102B. The insulating layer 102C includes a bowl 120C and a pair of notches 118, as well as flat portions 108E, which are dimensioned to fit between the barrier layer 102A and conductive layer 102B. The insulating layer 102C will not have a sidewall, but will have a circumference that fits within the sidewall 505 of the barrier layer 102A. The insulating layer 102C is made of a material having a thermal conductivity of 2 W/m·° C. or less. The thickness of the insulating layer 102C can vary according to the material used to make the insulating layer. Materials that can be used for the insulating layer 102C include gas, vacuum, or a ceramic material. Suitable ceramic materials include green bodies of ceramic particles. That is to say, the insulating layer 102C may not be a monolithic body of ceramic material, but a collection of ceramic particles that adhere to each other, with or without a binder material, and that can be manipulated to conform to any shape imposed upon the collection of particles, or green body. The ceramic material may include alumina, silica, titania, zirconia, silicon carbide, tungsten carbide, diamond-like material, and the like. The insulating layer 102C will be made to obtain a combustion temperature in a range such as 400° C. to 750° C. In some embodiments, the insulating layer 102C will be able to operate in a combustion chamber reaching a temperature in a range of 450° C. to about 725° C., such as about 500° C. to about 700° C. FIG. 7B shows a cross-sectional, exploded view of a three-layered piston crown, similar to that shown in FIG. 7A.

As with the two-layered piston crown, described above, the three layers of the piston crown 700 can be joined using any suitable fabrication technique, including additive manufacturing or welding. When using an additive manufacturing technique, the layers, though described above as discrete layers, may have interfaces in which the materials of the adjacent layers mix or interact. Conversely, in implementations where the layers of the piston crown 700 are joined by welding along sidewalls 505 and 510, adjacent layers may have discontinuities or gaps between the layers.

In some implementations, the piston crown is formed by casting and over casting. In this type of fabrication, the first layer cast is the barrier layer. The insulating layer is formed separately, for example by 3D printing or slipcasting. A second layer, the conductive layer, is cast over the first layer with the insulating layer inserted between the first and second layers. When the types of material used require, the conductive layer can be the first layer cast and the barrier layer can be the second layer cast, with the insulating layer inserted between the first and second layer during fabrication.

Figure 8A:
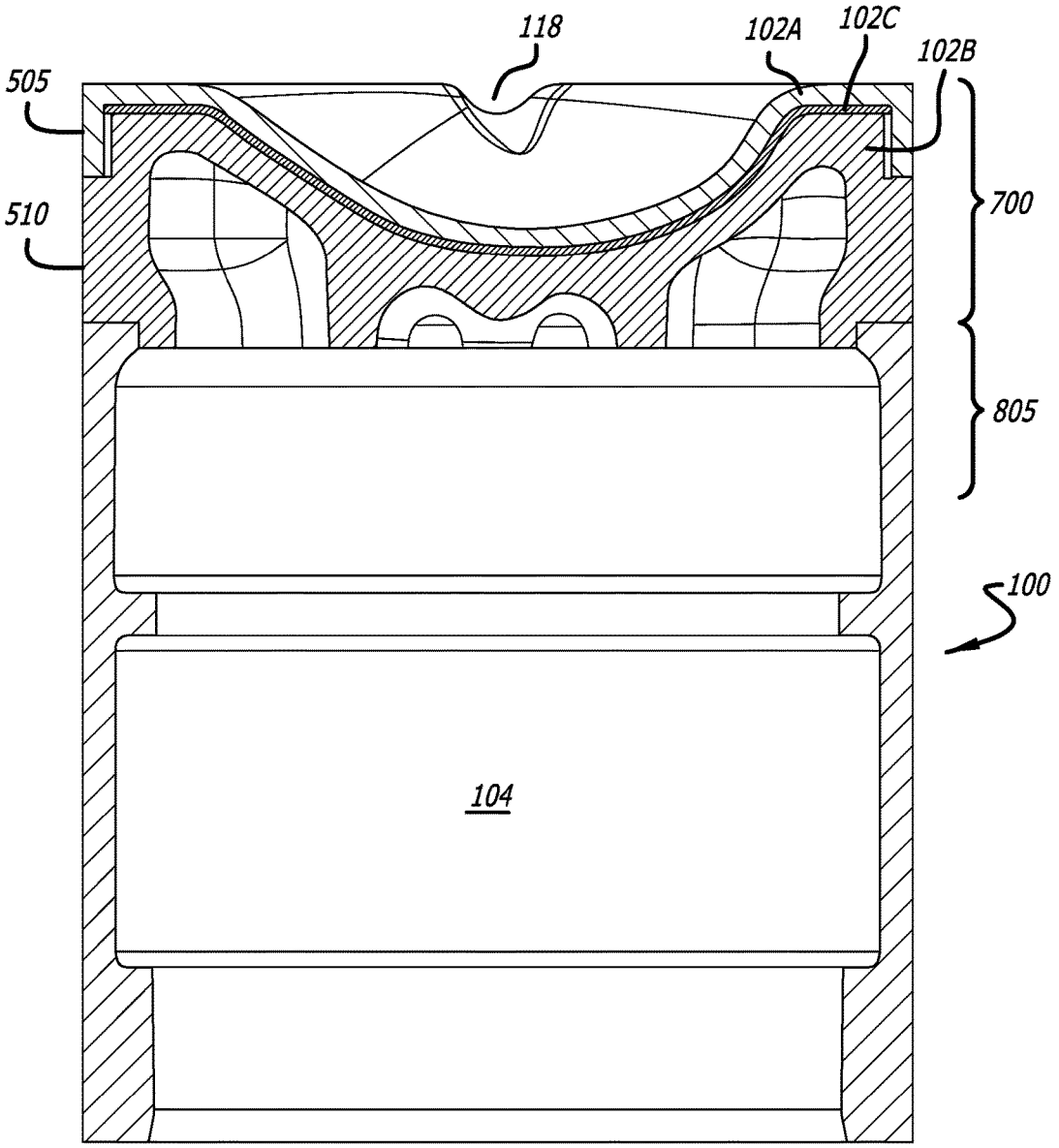
FIG. 8A is a longitudinal cross-sectional view of a piston including the multi-layer crown of FIG. 7A.
Figure 8B:
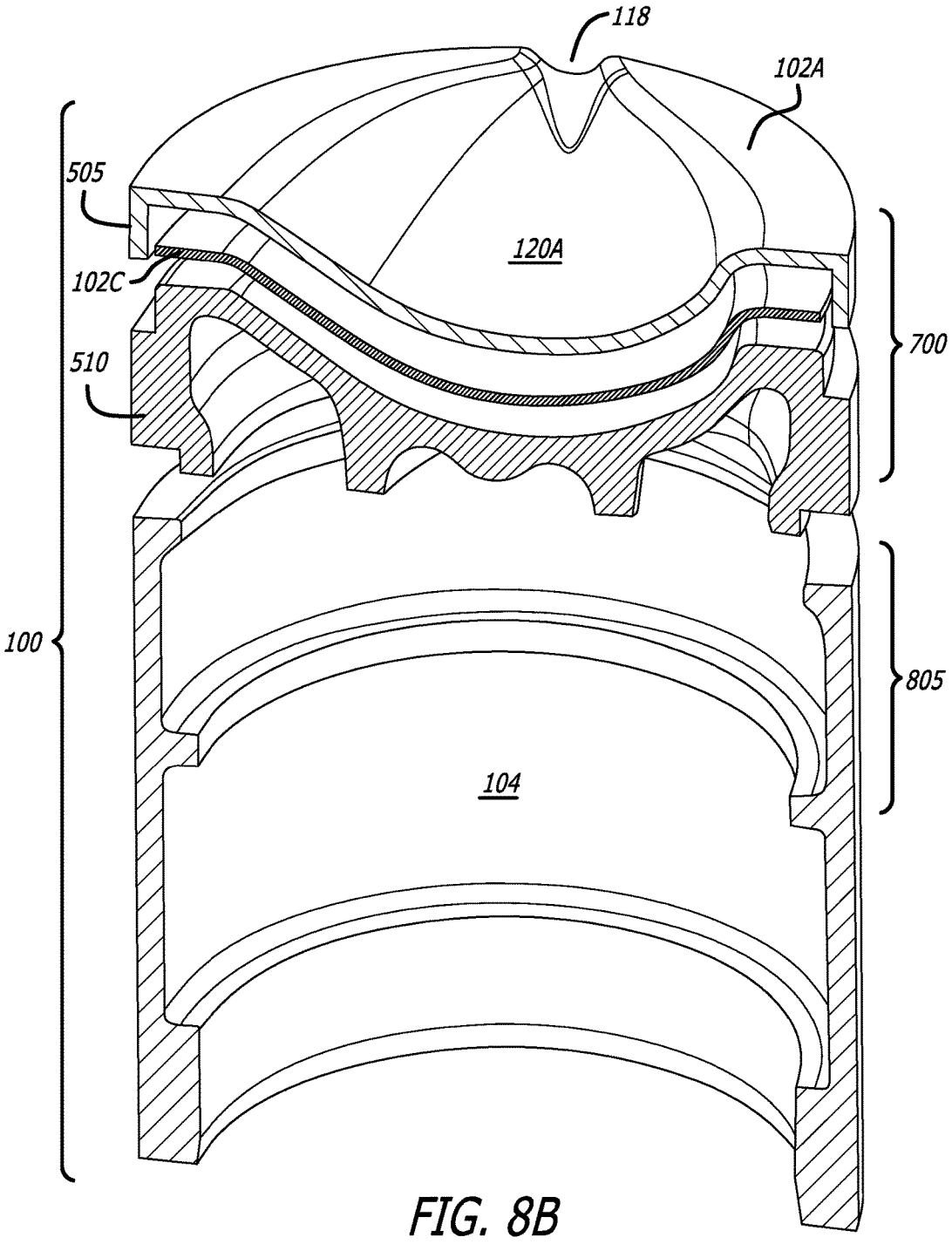
FIG. 8B is a longitudinal diametric sectional view of a piston including the multi-layer crown of FIG. 7A.

FIGS. 8A and 8B show cross-sectional views of a three-layered piston crown 700 as shown in FIGS. 7A and 7B, atop a piston skirt 104. In these views, the crown 700 and piston skirt 104 together form the bulk of the outer portion of the piston 100. Though the piston 100 is shown without ring grooves, the upper portion 805 of the skirt 805 could be formed with ring grooves. In such pistons, the construction of the piston crown 700 may account for the ring grooves by thermally insulating the grooves, as needed Though the multi-layered piston crown described herein is described with respect to piston crowns with a particular configuration of bowl and combustion chamber, the multi-layered structure of the crown with a barrier layer and conductive layer can be used with bowls and combustion chambers of any configuration, including those with rotational symmetry or a different, asymmetric configuration than that shown and described herein. Further, though each layer (e.g., barrier layer, conductive layer, insulating layer) is described as a discrete layer of one material, in some implementations, each layer may include more than one material either as a composite of a matrix material and a reinforcing material, a solid solution of materials, or as multiple layers of different materials.

The scope of patent protection afforded the novel tools and methods described and illustrated herein may suitably comprise, consist of, or consist essentially of a piston crown with two or more layers, in which the layers include at least a barrier layer and a conductive layer and the methods of fabricating such a piston crown. Further, the novel tools and methods disclosed and illustrated herein may suitably be practiced in the absence of any element or step which is not specifically disclosed in the specification, illustrated in the drawings, and/or exemplified in the embodiments of this application. Moreover, although the invention has been described with reference to the presently preferred embodiment, it should be understood that various modifications can be made without departing from the spirit of the invention. Accordingly, the invention is limited only by the following claims. Further, the scope of the novel piston crown described and illustrated herein may suitably comprise, consist of, or consist essentially of the elements two or more layers, in which the layers include at least a barrier layer and a conductive layer and the methods of fabricating such layers and the resulting piston crown. The novel piston crown disclosed and illustrated herein may suitably be practiced in the absence of any element which is not specifically disclosed in the specification, illustrated in the drawings, and/or exemplified in the embodiments of this application.

The invention claimed is:

1. An internal combustion engine including at least one cylinder with longitudinally-separated exhaust and intake ports and a pair of pistons disposed in opposition to one another in a bore of the cylinder, each piston including: a piston body with a crown at one end; and an end surface on the crown, in which the end surface of a first piston has a bowl that cooperates with the end surface of an opposing piston to define a combustion chamber, the crown comprising: a barrier layer located in the end surface such that the combustion chamber is enclosed at least in part by the barrier layer, the barrier layer having a thermal conductivity of 15 W/m·° C. or less and consisting of one of Hastelloy®, Inconel®, Waspaloy®, a René® alloy, a Haynes Alloy, Incoloy®, MP98T, and a CMSX single crystal alloy; an insulating layer having a thermal conductivity of 2 W/m·° C. or less; and a conductive layer located adjacent to the barrier layer, the conductive layer connecting the crown to the rest of piston body and having a thermal conductivity of 25 W/m·° C. or more, in which: the insulating layer is between the barrier layer and the conductive layer, the barrier layer and the conductive layer each have a bowl, a pair of notches, and a sidewall portion, the insulating layer does not have a sidewall and has a circumference that fits within the sidewall of the barrier layer, and the crown is attached to the piston body above piston ring grooves by welding.

2. The internal combustion engine of claim 1, further comprising, in each piston at least one void between the barrier layer and the conductive layer of the crown.

3. A piston for a two-stroke, opposed-piston, internal combustion engine, comprising: a piston body with a crown at one end, the crown including: an end surface formed on the crown, the end surface including an elongated bowl that cooperates with an opposing piston end surface to define a combustion chamber; a barrier layer located in the end surface such that the combustion chamber is enclosed at least in part by the barrier layer, the barrier layer having a thermal conductivity of 15 W/m·° C. or less; a conductive layer located adjacent to the barrier layer, the conductive layer connecting the crown to the rest of piston body and having a thermal conductivity of 25 W/m·° C. or more; and at least one void formed from a discontinuity between the barrier layer and the conductive layer in which: the barrier layer and the conductive layer each have a bowl, a pair of notches, and a sidewall portion, the barrier layer and the conductive layer are joined along their respective sidewalls, and the crown is attached to the piston body above piston ring grooves by welding.

4. The piston of claim 3, further comprising: an insulating layer between the barrier layer and the conductive layer, the insulating layer having a thermal conductivity of 2 W/m·° C. or less in which the insulating layer does not have a sidewall and has a circumference that fits within the sidewall of the barrier layer.

5. The piston of claim 3, in which the crown has two or fewer axis of symmetry in plan view.

6. The piston of claim 3, in which the barrier layer consists of one of Hastelloy®, Inconel®, Waspaloy®, a René® alloy, a Haynes Alloy, Incoloy®, MP98T, and a CMSX single crystal alloy.

7. A method of making a piston crown for a piston for a two-stroke, opposed-piston, internal combustion engine, the method comprising: forming a barrier layer having a thermal conductivity of 15 W/m·° C. or less and configured to at least partially enclose a combustion chamber formed by the piston crown and an end surface of an opposing piston; forming a conductive layer having a thermal conductivity of 25 W/m·° C. or more and configured to connect the piston crown to other components of the piston; forming an insulating layer configured for insertion between the barrier layer and the conductive layer; and joining the barrier layer and the conductive layer, in which: the barrier layer and the conductive layer each have a bowl, a pair of notches, and a sidewall portion the insulating layer does not have a sidewall and has a circumference that fits within the sidewall of the barrier layer, and joining the barrier layer and the conductive layer comprises joining the barrier and conductive layers along their respective sidewalls.

8. The method of claim 7, in which the insulating layer comprises a material with a thermal conductivity value of 2 W/m·° C. or less.

9. The method of claim 7, in which the barrier layer and the conductive layer are manufactured separately and in which joining the barrier and conductive layer comprises welding.

10. The method of claim 9, in which welding comprises electron beam welding, laser welding, or impulse welding.

11. The method of claim 7, in which: the barrier layer and the conductive layer are manufactured separately; the insulating layer comprises ceramic particles that are formed into the insulating layer by 3D printing, casting, or molding; and in which joining the barrier and conductive layer comprises welding.

12. The method of claim 7, in which:

the barrier layer is cast as a first layer of the crown and the conductive layer is cast as a second layer of the crown above the first layer; or the conductive layer is cast as a first layer of the crown and the barrier layer is cast as a second layer of the crown above the first layer.

13. The method of claim 12, in which the insulating layer is inserted above the first layer of the crown before casting the second layer of the crown.

14. The method of claim 7, in which the barrier layer consists of one of Hastelloy®, Inconel®, Waspaloy®, a René® alloy, a Haynes Alloy, Incoloy®, MP98T, and a CMSX single crystal alloy.

* * * * *